US006892794B2

(12) United States Patent
Zajber et al.

(10) Patent No.: US 6,892,794 B2
(45) Date of Patent: May 17, 2005

(54) METHOD AND DEVICE FOR CONTINUOUS CASTING AND SUBSEQUENT FORMING OF A STEEL BILLET, ESPECIALLY A BILLET IN THE FORM OF AN INGOT OR A PRELIMINARY SECTION

(75) Inventors: Adolf Zajber, Langenfeld (DE); Thomas Fest, Moers (DE)

(73) Assignee: SMS Demag Aktiengesellschaft, Dusseldorf (DE)

( * ) Notice: Subject to any disclaimer, the term of this patent is extended or adjusted under 35 U.S.C. 154(b) by 0 days.

(21) Appl. No.: 10/399,743

(22) PCT Filed: Sep. 28, 2001

(86) PCT No.: PCT/EP01/11222

§ 371 (c)(1),
(2), (4) Date: Apr. 21, 2003

(87) PCT Pub. No.: WO02/34432

PCT Pub. Date: May 2, 2002

(65) Prior Publication Data

US 2004/0020633 A1 Feb. 5, 2004

(30) Foreign Application Priority Data

Oct. 20, 2000 (DE) ..... 100 51 959

(51) Int. Cl.[7] ..... B22D 11/124; B22D 11/128; B22D 11/20; B22D 11/22

(52) U.S. Cl. ..... 164/484; 164/455; 164/486; 164/414; 164/442; 164/444

(58) Field of Search ..... 164/454, 455, 164/476, 484, 486, 413, 414, 442, 444

(56) References Cited

U.S. PATENT DOCUMENTS 4,031,946 A * 6/1977 Marti et al. ..... 164/486
5,238,047 A * 8/1993 Sakata ..... 164/448

FOREIGN PATENT DOCUMENTS

| | | |
|---|---|---|
| EP | 0 804 981 | 11/1997 |
| JP | 58148059 | 9/1983 |
| JP | 03090258 | 4/1991 |

* cited by examiner

*Primary Examiner*—Kuang Y. Lin
(74) *Attorney, Agent, or Firm*—Herbert Dubno

(57) ABSTRACT

The secondary cooling and the strand support are matched to the cooling state of a continuously cast strand cross section. The secondary cooling and support are reduced in dependence upon the solidification profile of the cast strand along the distance traveled.

17 Claims, 4 Drawing Sheets

METHOD AND DEVICE FOR CONTINUOUS CASTING AND SUBSEQUENT FORMING OF A STEEL BILLET, ESPECIALLY A BILLET IN THE FORM OF AN INGOT OR A PRELIMINARY SECTION

CROSS REFERENCE TO RELATED APPLICATIONS

This application is a national stage of PCT/EP01/11222, filed 28 Sep. 2001 and based upon German national application 100 51 959.8 filed 20 Oct. 2000 under the International Convention.

FIELD OF THE INVENTION

The invention relates to a method and a device for continuous casting and subsequent shaping of a cast strand or billet of steel, especially a cast strand with an ingot shape or the shape of a preliminary section or structural shape, in which the geometries of the secondary cooling and strand guide are matched to the cooling state of the cross section of the cast strand or billet.

BACKGROUND OF THE INVENTION

In general in continuous casting for different types of steel and products of different dimensions or layouts, attention is directed to the growth of the solidifying strand shell only during the secondary cooling and to the position of the molten pool or sump tip in a deformation stretch. Thus it is known (EP 0 804 981 A) to squeeze the cast strand or billet in the deformation stretch so that the desired final thickness will result. For that purpose it is however only required to establish the position of the molten pool tip, based upon which the deformation force is applied horizontally along a wedge surface. Such a process is coarse and does not take into consideration the state of the lattice structure to be expected. The reasons lie in the disadvantageous heat distribution by disadvantageous cooling and a uniform strand bracing with nonuniform heat abstraction from the strand cross section. A matching of the secondary cooling to the strand support likewise is not to be found.

OBJECT OF THE INVENTION

The invention presents as its object to so match the secondary cooling, strand support and deformation temperature to one another that even types of steel which are also very difficult to cast, can be cast and, indeed, so that all qualities of steel, in which segregations and porosities are of significance for further processing and end-use purposes can be used and, aside from this, features improved internal qualities and surface qualities.

SUMMARY OF THE INVENTION

The object set forth is achieved according to the invention in that the secondary cooling has its geometrical configuration matched respectively and analogously to the solidification profile of the immediately following length segment of the cast strand or billet and in that the strand support likewise is reduced analogously depending upon the solidification profile of the cast strand at the immediately following length segment. The strand support can be matched to the strand shell growth on all sides in that the roller box lengths are the same as or smaller than the molten-pool or sump width, whereby edge cooling is avoided. In this manner the cast material is significantly improved as to its lattice structure, i.e. its internal structure qualities, and its surface quality.

According to a refinement, the corner regions of the cast strand cross section are less cooled with increasing travel distance cast strand segment length than the middle regions. The individual sides are thus cooled with reduced application of water thereto to optimize the temperature distribution in the strand cross section, whereby a subsequent soft-reduction process can also be influence.

According to a further refinement it is proposed that the spray jets in the secondary cooling be so matched with their spray angles to the strand shell thickness that as the molten-pool or sump width becomes smaller, a smaller spray angle is used. In this way, the secondary cooling is matched using the spray angle to the strand shell growth and creates an optimal temperature distribution in the strand cross section and also at the surface so that there is weaker temperature drop at the edges.

A similar effect can be brought about with a decreasing molten-pool or sump width in that the spacing of the spray nozzles producing the spray jets from the strand or billet surface is varied in dependence upon the solidification profile.

A further heat withdrawal is also limited in that, in accordance with another feature, the corner regions of the cast strand or billet cross section with increasing travel distance is supported to a lesser extent than the middle region. The lack of contact by longer support rollers then reduces the heat abstraction.

A further development of the features of temperature distribution and equalization is that the corner regions and/or the side surfaces of the cast strand or billet cross section are insulated against heat abstraction. The process-matched secondary cooling for producing an optimal solidification structure is followed by a targeted thermal insulation of the strand cross section for producing a softer strand cross section core for the soft-reduction process.

Furthermore it is provided that, in addition to insulating the corner regions and/or the side surfaces of the strand cross section, the upper and lower sides of the strand are selectively intensively cooled with a coolant. For this purpose especially the middle regions are considered so that there will be a further reduction in the molten-pool or sump width. On the upper side of the strand and the lower side of the strand a cooling of the surfaces is effected to provide harder and deformation-stiffer pressing surfaces for the soft-reduction process ahead of the soft-reduction segment.

After there has been a significant equalization of the temperature in the strand cross section over layers of the strand cross section, it is advantageous to roll the cast strand cross section from the top down in accordance with the so-called soft-reduction process.

A device for continuous casting and subsequent shaping of a cast strand or billet of steel, especially a cast strand or billet with an ingot shape, whereby the secondary cooling and the strand guiding are matched geometrically to the cast strand or billet cross section, attains the objects set forth for the invention in that the secondary cooling is carried out in dependence upon the solidification profile and the distance traveled beginning substantially with the full strand width, and in that the secondary cooling and the strand support are so reducible in dependence upon the solidification profile within the distance traveled that the cast strand or billet before entry into the soft-reduction segment is supported only at the underside of the strand across the strand width. As a result, apart from the process-technological improvements an improvement in the cost effectiveness of the device is obtained by a loading-matched configuration of the machine components, mechanical and thermal stresses are reduced.

To avoid excessive heat abstraction at the edges of the strand cross section it is proposed to arrange cover elements on the side surfaces and/or the corner regions of the cast strand cross section within the secondary cooling and the strand support.

According to a further development it is provided that the soft reduction segment is formed at its beginning and end with driven driver rollers in the driver frame and that the soft reduction segment is formed from at least two rollers frames with roller pairs without drives, whereby the upper frame is respectively adjustable relative to the lower frame hydraulically. In this manner in the soft reduction segment the soft reduction can be carried out using a multiroller segment. A continuous convergence produces a continuous soft reduction process over a selectable length. The theoretical precalculation of the molten-pool or sump thickness over the last meter in the final solidification region is determined by a suitable convergence setting and its length.

Other features reside in that in the continuous casting movement direction ahead of and downstream of the soft reduction segment one or more driver frames are arranged. In this manner the cast strand or billet can be sufficiently transported in the deformation region and the deformation forces applied in a sufficient degree.

According to other features it is provided that upstream and/or downstream of a straightening driver, an intensive cooling device is provided for the upper side of the strand and the lower side of the strand of the continuous casting strand cross section. Several steel qualities shown in further processing by so-called "quenching" a better surface structure. In combination with the cooling upstream of the soft reduction process this effect can also be achieved. The effect of the soft reduction brought about by the mechanical units (segments, driver frames) can be supported by a so-called "thermal soft reduction". For this purpose the cast strand in the regions which are here under consideration can be additionally treated with water in a targeted manner.

Another arrangement resides in that upstream of a soft reduction segment, an intensive cooling device is arranged for the strand upper side and the strand lower side of the cast strand cross section.

A further configuration is provided in that the soft reduction segment forms a unit which is shiftable in the strand continuous casting movement direction or opposite the strand movement direction and which is arranged ahead of one or more driver frames.

In addition it is proposed that the soft reduction segments in the continuous casting strand movement direction be arranged downstream of the straightening and extracting machine (the driver frames).

BRIEF DESCRIPTION OF THE DRAWING

In the drawing embodiments of the invention have been shown which are described below in greater detail.

In the drawing.

SPECIFIC DESCRIPTION

Figure 1:
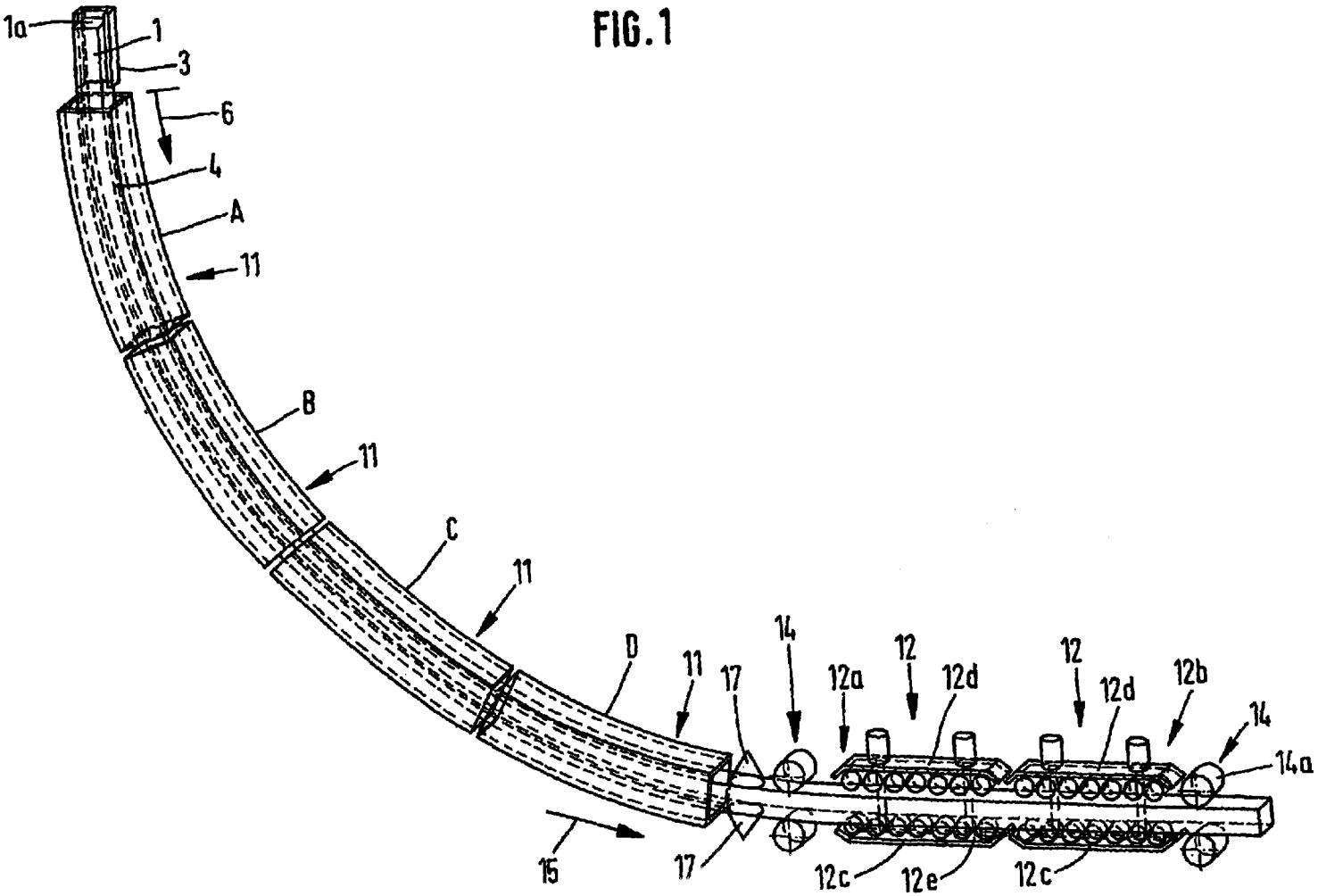
FIG. 1 is a side elevational view of an arcuate continuous casting apparatus for an ingot shape with soft reduction as a first alternative.
Figure 2A:
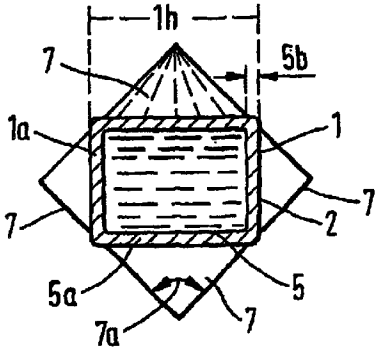
FIG. 2*a* is a sectional view of the cast strand or billet cross section in the secondary cooling with a relatively larger molten-pool or sump width and thin strand shell.

The method of continuous casting of steel in rectangular or ingot shapes according to FIG. 1 is characterized by cooling, supporting and shaping. The continuously cast strand or billet 1 with a cast strand cross section 1*a* comprises in the exemplary embodiment an ingot shape 2 and emerges from a continuous casting mold 3 and is directly cooled in a secondary cooling. As a result it passes from arc segment A to arc segment B, C and D each with a solidification profile 5 (FIGS. 2*a*, 2*b*, 2*c*) in which an already solidified strand shell 5*a* grows from arc segment to arc segment with increasing strand shell thickness 5*b*. The method operates so that the secondary cooling 4, in its geometrical configuration, is analogously matched to the solidification profile 5 of the cast strand 1 over the respective travel length 6 of the continuous strand from arc segment A to arc segment D, and whereby a strand support 11 also is reduced analogously as a function of the solidification profile of the cast strand 1 over the following travel length 6. As a result the corner regions 1*b* of the cast strand cross section 1*a* with increasing travel length 6 are less cooled than in the central regions 1*c*.

This rule can be followed in that the spray jets 7 in the secondary cooling 4 have their spray angles 7*a* so matched to the respective continuous strand shell thickness 5*b* that a smaller spray angle 5*a* is associated with a sump width [molten pool width] 8 which becomes smaller.

Figure 2B:
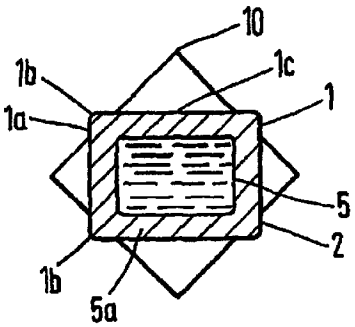
FIG. 2*b* is a similar view of the same cast strand cross section with reduced spray jet width and reduced sump width.
Figure 2C:
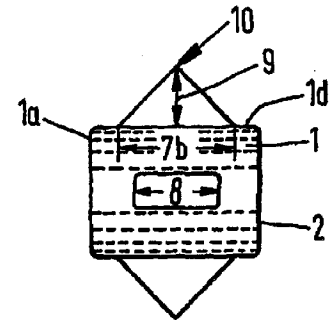
FIG. 2*c* is a sectional view of the same cast strand cross section with further reduced spray jet width at the strand upper side and the strand lower side and further reduced sump width.

Alternatively, the spacing 9 of the spray nozzle 10 producing the spray jets 7 from the strand upper surface 1*d* is reduced as a function of change in the hardening profile 5 (FIG. 2*b*).

Figure 3A:
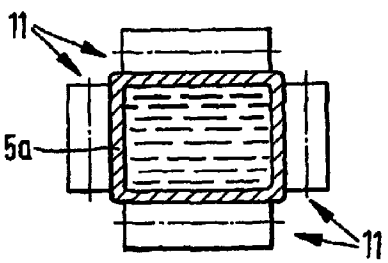
FIG. 3*a* is a sectional view of the continuously cast strand cross section with the strand shell thickness corresponding to FIG. 2*a* and wider strand support.
Figure 3B:
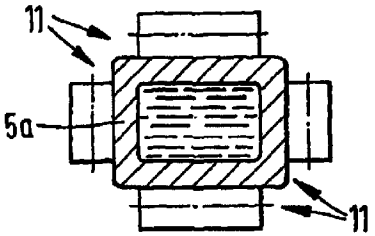
FIG. 3*b* is a similar section of the cast strand cross section with the strand shell thickness corresponding to FIG. 2*b* and reduced strand support.
Figure 3C:
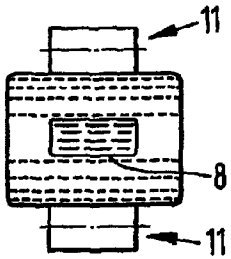
FIG. 3*c* is another section of the strand cross section with the strand shell thickness corresponding to FIG. 2*c* and a strand support at the upper and lower sides of the strand.

In this sense, the corner regions 1*b* of the cast strand cross section 1*a* are supported to a lesser extent than the middle regions 1*c* with increasing travel length 6 (FIGS. 3*a*, 3*b*, 3*c*).

Figure 4A:
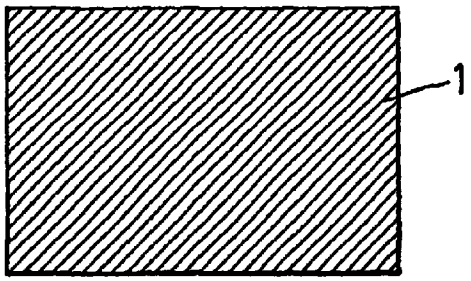
FIG. 4*a* is a sectional view of the cast strand cross section on conventional complete solidification without the invention and without covering the side surfaces.
Figure 4B:
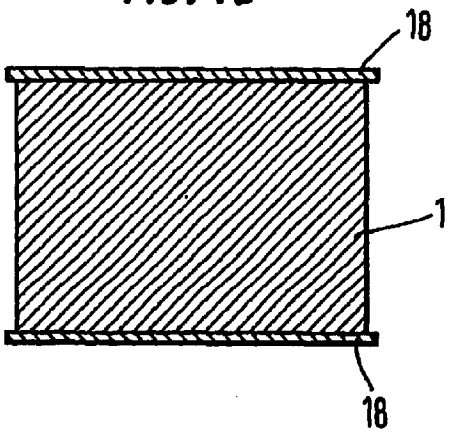
FIG. 4*b* is another section of the cast strand cross section without the pressure distribution according to the invention in the soft reduction and in which inclusions can develop.

FIGS. 4*a* and 4*b* show completely solidified cast strand 1 a largely uniform temperature distribution in its outer regions, whereby undesirable indentations 18 can form (FIG. 4*b*).

Figure 5A:
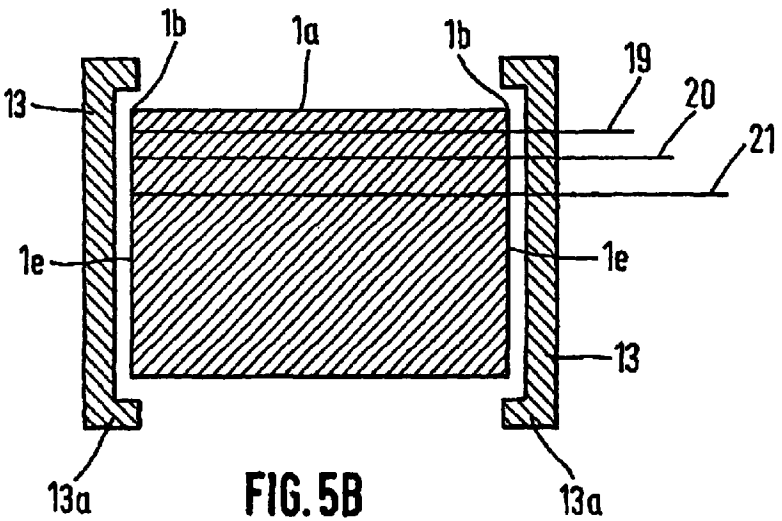
FIG. 5*a* is a sectional view of the continuous casting strand cross section with covering for a temperature distribution.
Figure 5B:
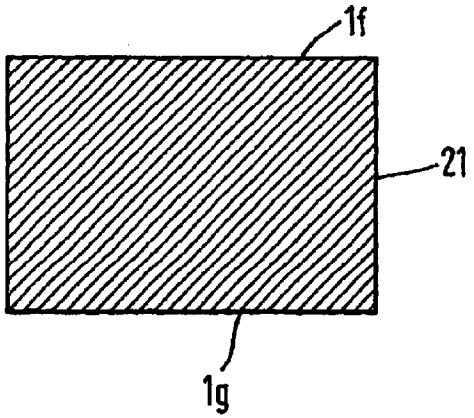
FIG. 5*b* is a similar section of the continuous casting strand cross section with temperature distribution according to the invention in the soft reduction.

For a uniform heat distribution in a form for subsequent deformation processing, the corner regions 1 and/or the side surface 1*e* of the cast strand cross section 1*e* are insulated against heat abstraction (FIGS. 5*a* and 5*b*). As a result zones of different temperature 19, 20 and 21 are formed. In the middle of the cast strand cross section 1*a* and the temperature zone 21 prevails (FIG. 5*b*) in which deformation work by pressing from above downwardly is promoted. In this central region the temperature is higher than above and below it and as a result segregation are easily dispersed and porosity eliminated.

In addition to insulating the corner regions 1*b* and or the side surfaces 1*e*, the cast strand cross section 1*a* is selectively intensively cooled with a coolant at the strand upper side 1*f* and the strand lower side 1*g*.

In a further process step, the strand cross section 1*a* is rolled from top to bottom by the so-called soft reduction method whereby an otherwise customary squeezing does not occur.

The illustrated device for continuous casting and subsequent shaping of a cast strand 1 of steel especially are cast strand 1 with an ingot 2 with a secondary cooling 4 and the strand support 11 is matched to the cooling state of the cast strand cross section 1*a* is so shaped that the secondary cooling 4 as a function of the solidification profile 5 and the set back travel length 6, commences with substantially the full strand width 1*a*, the secondary cooling 4 and strand support 11 being reduced, depending upon the solidification profile 5 of the cast strand 1 within the travel length 6 for such that the cast strand 1 before entry into a soft reduction segment 12 is supported only at the underside 1*g* of the strand width 1*h*. In order to bring about the desired temperature distribution with a deformable layer in the middle, within the secondary cooling 4 and the strand support 11, on the side surfaces 1*e* of the cast strand cross section 1*e* and/or on the corner regions 1*b*, cover elements 13 are arranged which can form the angle pieces 13*a*.

The soft reduction segment has at its start 12*a* and its end 12*b*, driver frames 14 with driven drive rollers 14*a*. The soft reduction segment 12 is comprised itself of two or more roller frames 12*c* whose roller pairs are without drives. An upper frame 12*d* is hydraulically adjustable relative to the lower frame 12*e*.

One or more driver frames 14 are arranged in the strand movement direction 15, in addition, upstream and downstream of the soft reduction segment 12.

In order to produce the desired temperature distribution in horizontal through-hardened layers upstream of a soft reduction segment 12 an intensive cooling device 17 is arranged for the strand upper side 1*f* and the strand lower side 1*g* of the cast strand cross section 1*a*. This raises the strength and forms a soft reduction preparation. The intensive cooling on the strand upper side 1*f* and the strand lower side 1*g* can be provided also upstream of the controllable soft reduction segment 12.

Figure 6:
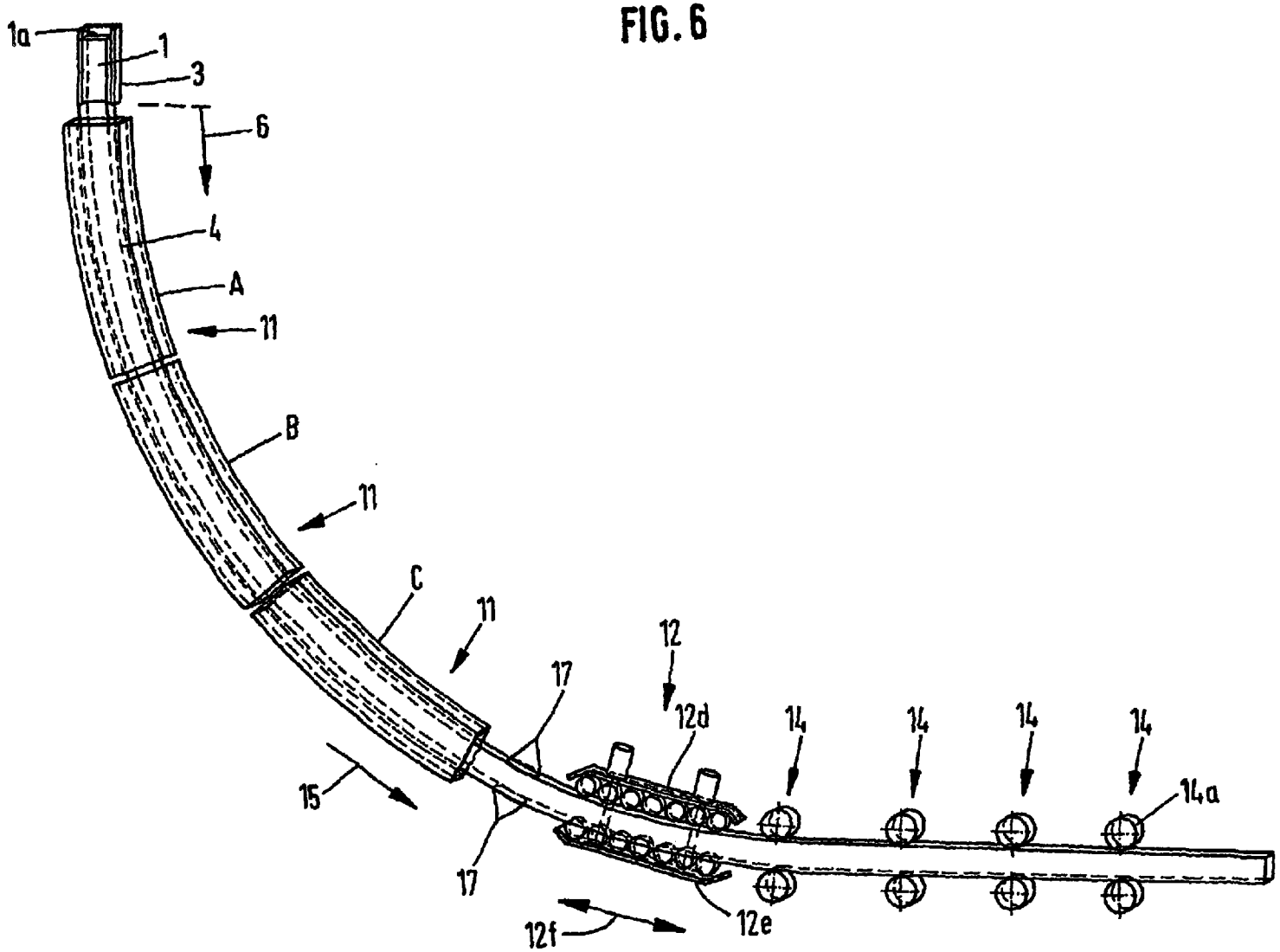
FIG. 6 is a side elevational view of an arcuate continuous casting apparatus for an ingot shape with soft reduction as a second alternative.

In FIG. 6 a second alternative configuration is shown. There the soft reduction segment 12 is configured as a shiftable unit 12*f* which can be displaced in the strand movement direction 15 or opposite the strand movement direction. The segment 12 is arranged upstream of one or more driver frames 14.

The soft reduction segment in the straightening roller region can be used in conjunction with driven extraction rollers in ingot plants generally having two straightening points. Because of the elastoplastic properties of the material in a bending-straightening process, the cast strand 1 develops a straight configuration. By contrast with slab plants in which the strand makes the transition to a straight shape via a curved path, the ingot strand in the straightening region has a bend line which depends upon such parameters as the moment of inertia, the temperature of the cast strand and the temperature distribution within the cast strand cross section and which may differ depending upon the straightening point over short stretches. A predetermined curved path can be provided in the soft reduction segment 12 and the cast strand 1 can be brought into a state (determined in terms of the theoretical elastic limit, the flow properties or the like) which in a normal case can yield a reduced force cost for additional soft reduction.

What is claimed is:

1. A method of continuously casting and then deforming a cast strand of steel comprising:

(a) in the continuous casting of the strand, carrying out a secondary cooling and strand guidance matched to a cooling state of the cast strand cross section;

(b) matching the secondary cooling in its geometrical configuration analogously to a solidification profile of the cast strand of a following traveling length of the cast strand; and (c) reducing a strand support analogously as a function of the solidification profile of the cast strand at the respective travel length.

2. The method according to claim 1 wherein the corner regions of the cast strand cross section with increasing travel length are less cooled than in the middle regions.

3. The method according to claim 2 wherein secondary cooling is carried out by spray jets and the spray jets in the secondary cooling have their spray angles so matched to the strand shell thickness that a smaller molten pool width has a jet with a smaller spray angle juxtaposed therewith.

4. The method according to claim 3 wherein the spacing of spray nozzles producing the spray jets from the strand surface along the strand surface is varied as a function of the solidification profile along the strand surface.

5. The method according to claim 4 wherein corner regions of the cast strand cross section are supported to a lesser degree than the central region with increasing travel length.

6. The method according to claim 5 wherein the corner regions and/or the side surfaces of the cast strand cross section are insulated against heat abstraction.

7. The method according to claim 6 wherein, in addition to the insulation of the corner regions and/or the side surfaces of the strand cross section, the strand upper side and the strand lower side are selectively intensively cooled with a coolant.

8. The method according to claim 7 wherein the cross strand cross section is rolled from the top downwardly by the soft reduction method.

9. A device for continuous casting and then deforming a cast strand of steel with an ingot shape comprising a secondary cooling and strand guidance stretch matched to a cooling state of the cast strand cross section; and a straightening and extraction mechanism downstream of said stretch the secondary cooling being carried out in dependence upon the solidification profile and the travel length beginning substantially with the full strand width being extracted, the secondary cooling and the strand support being so reduced as a function of the solidification profile of the cast strand within the travel length that the cast strand before entering the soft reduction segment is only supported on the strand underside of the strand width.

10. The device according to claim 9 wherein the secondary cooling and the strand support cover elements are arranged on the side surfaces of the cast strand cross section and on the corner regions of the strand.

11. The device according to claim 10 wherein at a start and end of the soft reduction segment, drive frames with driven driver rollers are provided and that the soft reduction segment is comprised of at least two roller frames with roller pairs without drives and an upper frame which can be adjustable hydraulically with respect to the lower frame.

12. The device according to claim 11 wherein one or more driver frames are arranged in the strand movement direction upstream and downstream of the soft reduction section.

13. The device according claim 12 wherein in intensive cooling device is arranged upstream and/or downstream of a straightening driver for the strand upper side and the strand lower side of the cast strand cross section.

14. The device according to claim 13 wherein upstream of a soft reduction segment an intensive cooling device is arranged for the strand upper side and the lower side of the cast strand cross section.

15. The device according to claim 14 wherein the soft reduction segment forms a unit shiftable in the strand movement direction or opposite the strand movement direction and is arranged upstream of one or more drive frames.

16. The device according to claim 15 wherein the soft reduction segment is arranged as a straightening and soft reduction segment between the driver frames.

17. The device according to claim 16 wherein the soft reduction segment is arranged in the strand movement direction downstream of the straightening and extraction mechanism.

* * * * *